US006860782B2

(12) United States Patent
Hornsby et al.

(10) Patent No.: US 6,860,782 B2
(45) Date of Patent: Mar. 1, 2005

(54) BUBBLE MAKING AMUSEMENT DEVICE

(75) Inventors: James Russell Hornsby, St. Louis, MO (US); Chad P. Stuemke, St. Louis, MO (US); Paul M. Brown, St. Louis, MO (US)

(73) Assignee: All Season Toys, Inc., Malibu, CA (US)

( * ) Notice: Subject to any disclaimer, the term of this patent is extended or adjusted under 35 U.S.C. 154(b) by 0 days.

(21) Appl. No.: 09/941,473

(22) Filed: Aug. 29, 2001

(65) Prior Publication Data

US 2002/0061697 A1 May 23, 2002

Related U.S. Application Data

(60) Provisional application No. 60/229,586, filed on Aug. 31, 2000.

(51) Int. Cl.[7] ..... A63H 33/28
(52) U.S. Cl. ..... 446/15; 446/475
(58) Field of Search ..... 446/15, 16, 18, 446/21, 176, 178, 179, 180, 483, 473, 475

(56) References Cited

U.S. PATENT DOCUMENTS

| | | | | |
|---|---|---|---|---|
| 2,393,039 A | | 1/1946 | Gilchrist, Jr. | |
| 2,675,641 A | | 4/1954 | Baggott | |
| 2,700,845 A | * | 2/1955 | Arliss | 446/18 |
| 2,974,438 A | | 3/1961 | Hopkins | |
| 2,989,818 A | | 6/1961 | Filger et al. | |
| 3,775,899 A | | 12/1973 | Wolf | |
| 3,814,394 A | | 6/1974 | Murray | |
| 3,834,066 A | * | 9/1974 | Vargas | 446/21 |
| 4,128,962 A | * | 12/1978 | Anderson | 446/15 |
| 4,334,383 A | | 6/1982 | Melotti | |
| 4,423,565 A | | 1/1984 | Bart | |
| 5,224,892 A | | 7/1993 | Messina | |
| 5,224,893 A | | 7/1993 | Routzong et al. | |
| 5,234,129 A | | 8/1993 | Lau | |
| 5,366,402 A | | 11/1994 | Rudell et al. | |
| 5,462,469 A | * | 10/1995 | Lei | 446/15 |
| 5,498,191 A | | 3/1996 | DeMars | |
| 5,520,564 A | * | 5/1996 | DeMars | 446/15 |
| 5,613,890 A | | 3/1997 | DeMars | |
| 5,975,358 A | | 11/1999 | Zheng et al. | |
| 6,015,327 A | * | 1/2000 | Kovacs | 446/15 |
| 6,193,578 B1 | * | 2/2001 | Weber | 446/267 |
| 6,331,130 B1 | * | 12/2001 | Thai | 446/15 |
| 6,386,935 B1 | * | 5/2002 | Lin | 446/16 |
| 6,416,377 B1 | * | 7/2002 | Bart | 446/15 |

* cited by examiner

*Primary Examiner*—Derris H. Banks
*Assistant Examiner*—Faye Francis
(74) *Attorney, Agent, or Firm*—Richard B. Klar

(57) ABSTRACT

A handheld bubble making device includes a reservoir of bubble making solution that is drawn by a motorized pumping assembly and distributed over a dispensing surface. A motorized fan assembly blows air through the dispensing surface to generate bubbles. A dispensing ring is positioned adjacent to the dispensing surface and is moveable by the operator to aid in the distribution of the fluid across the dispensing surface. One or more lights are provided to illuminate the bubbles that are dispensed.

18 Claims, 5 Drawing Sheets

BUBBLE MAKING AMUSEMENT DEVICE

CROSS-REFERENCE TO RELATED APPLICATION(S)

This application claims priority from U.S. Provisional Application Ser. No. 60/229,586, dated Aug. 31, 2000.

FIELD OF THE INVENTION

The present invention relates to amusement devices or toys. More specifically, the present invention relates to an amusement device in the form of a bubble blowing device.

BACKGROUND OF THE INVENTION

Children and adults have enjoyed producing bubbles for many years. Tradtionally, a device having a ring portion is dipped into a liquid bubble making solution. The solution is formulated to reduce the surface tension of the liquid causing the solution to form a thin film across the ring. The operator causes air to flow through the ring, either by blowing through the ring or waving the ring through the air. The air flow causes the thin film to separate from the ring and form one or more bubbles.

SUMMARY OF THE INVENTION

The present invention provides an automated hand held bubble making device with an included light source that illuminates the bubbles generated by the device. The operator engages the device by pulling a trigger which actuates a motor and the light source. The motor drives a fan and a pump assembly that pumps fluids from a tank and applies the fluid against a dispensing surface. Air flow from the fan assembly blows against the fluid, causing the formation of bubbles that are ejected from the device and illuminated.

In one embodiment, the present invention is a bubble producing toy comprising a housing having an internal chamber, a dispensing opening connecting with the internal chamber and substantially open to the outside air, a sleeve mounted within the dispensing opening, and having a central opening and a dispensing surface, a reservoir mounted on the housing to contain a liquid capable of producing air bubbles, a pump mounted on the housing and connected to the reservoir by a tube to supply liquid to the pump, a source of blown air originating from within the internal chamber, the blown air to be dispensed into the central opening of the sleeve and out of the toy, and a film producing mechanism operably carried by the housing and including a dispensing ring located against the dispensing surface and movable across the dispensing surface, wherein liquid from the reservoir is moved by the pump to the dispensing surface and the dispensing ring helps provide a thin film of the liquid across the dispensing surface as the dispensing ring is moved across the dispensing surface to create an air bubble upon the blown air flowing against the thin film.

In one embodiment, the bubble producing amusement device or toy of the present invention comprises a handheld device generally including a handle portion and a bubble emitting portion, and is formed by a housing which supports a trigger mechanism. The housing contains and supports a tank for containing a bubble forming solution, a dispensing assembly, including a fan, a capillary pump assembly, an electrical motor for driving the fan and the pump assemblies, and a battery box.

In one embodiment, the dispensing assembly comprises a fan case with a generally cylindrical portion for containing the fan and the electrical motor, and a generally tubular portion having a free end adapted to carry a generally cylindrical dispensing nozzle with a circular dispensing surface. An annular dispensing ring is operably and movably mounted immediately adjacent to the dispensing nozzle for relative movement thereto, and is coupled to the trigger mechanism which also comprises the "switch" for actuating the pump and fan. The dispensing ring and the circular dispensing surface are generally parallel, and the center of the dispensing ring may be moved into and out of alignment with the central axis of the nozzle. A suitable feed tube or hose operably links the tank to the dispensing nozzle. The end of the feed tube or hose adjacent to the dispensing nozzle carries a funnel or fanning tip for allowing bubble solution to drip onto the dispensing surface and dispensing ring.

The pump arrangement comprises a transfer gear coupled to a pump gear which carries pump pushers or rollers for contacting the feed hose to create a capillary action to move bubble solution from the tank to the fanning tip. A portion of the housing wall may be shaped, e.g. arcuate shaped portion, to allow the pump to pinch the feed tube to create the vacuum to transport the solution through the feed hose to the fanning tip adjacent to the nozzle.

In one embodiment, suitable light sources, such as LED's, are carried by the housing generally in the bubble emitting portion adjacent to the dispensing nozzle. A recycling arrangement, including a catch funnel located generally under the dispensing nozzle, suitable tubing and a one-way valve, is provided. Additional light sources and light source controls may be provided in some embodiments, and light sources may be selectively located and operable to provide selected effects, e.g., continuous light, flashing, alternative or periodic lighting of selected portions of the device and/or bubbles produced, selected colors and/or intensities, etc.

In use, the tank, which may have a selected capacity, is filled with a suitable bubble solution. The trigger is pulled to start the motor to drive the pump to move bubble solution through the feed tube from the tank out to the fanning tip. The bubble solution is pumped and dripped out of the fanning tip on to the dispensing ring and nozzle, the annular dispensing ring helping to cause the solution to flow and/or be distributed around the dispensing surface of the nozzle. In addition to starting the pump, pulling the trigger starts the fan, and slides the dispensing ring out of congruence with the dispensing surface of the nozzle, to one side of the nozzle, to create a thin film of solution across the nozzle. Bubbles are created as the fan blows air against the thin film. The blown air also serves to launch or propel bubbles from the device.

In one embodiment, pulling the trigger also turns on the light sources, e.g., one or more LED's, to illuminate the bubbles as they are dispensed. In some embodiments, switches may be provided to actuate and/or control the light sources. Excess bubble solution from the dispensing ring and nozzle drips into the recycling funnel for recycling back into the tank.

In some embodiments, the present invention may further comprise a device and method for smart operation wherein a microprocessor or chip provides intelligence and control of, for example, operable components of the invention, including operation of the light sources for creating a selected effect, fan speed, or the like.

The housing or body forming portions of the device may include transparent, semi-transparent or opaque portions or areas to enhance the light emission or display, and/or the interest of the user.

The amusement device of the present invention may be used with any suitable bubble producing solution.

The present invention may be embodied in other specific forms without departing from the essential spirit or attributes thereof. It is desired that the described embodiments be considered in all respects as illustrative, not restrictive.

While multiple embodiments are disclosed, still other embodiments of the present invention will become apparent to those skilled in the art from the following detailed description, wherein is shown and described only the embodiments of the invention, by way of illustration, of the best modes contemplated for carrying out the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Features and advantages of the bubble producing amusement device and method of the present invention will become more fully apparent and understood with reference to the accompanying Figures, this description and the descriptive material enclosed herewith, including the described embodiments of a mechanized, substantially automatic bubble producing device and the method of its use and/or operation. The device is automated at least in the sense that it will operate to produce bubbles when actuated while containing sufficient bubble solution.

Fastening, mounting, attaching or connecting the components of the present invention to form the device as a whole, unless specifically described otherwise, are intended to encompass conventional fasteners such as screws, nut and bolt connectors, threaded connectors, snap rings, hose clamps such as screw clamps and the like, rivets, nuts and bolts, toggles, pins and the like. Components may also be connected by welding, friction fitting or deformation, if appropriate. Electrical connections may be made using appropriate electrical components and connection methods, including conventional, commercially available electronic components, connectors and devices such as suitable wiring, connectors, power supplies, printed circuit boards, microchips, speakers, lights, liquid crystal displays, audio components, inputs, outputs and the like. Unless specifically otherwise disclosed or taught, materials for making components of the present invention are selected from appropriate materials such as metal, metallic alloys, fibers, plastics and the like, and appropriate manufacturing or production methods including casting, extruding, molding and machining may be used.

Any references to front and back, right and left, top and bottom and upper and lower are intended for convenience of description, not to limit the present invention or its components to any one positional or spatial orientation.

Figure 1:
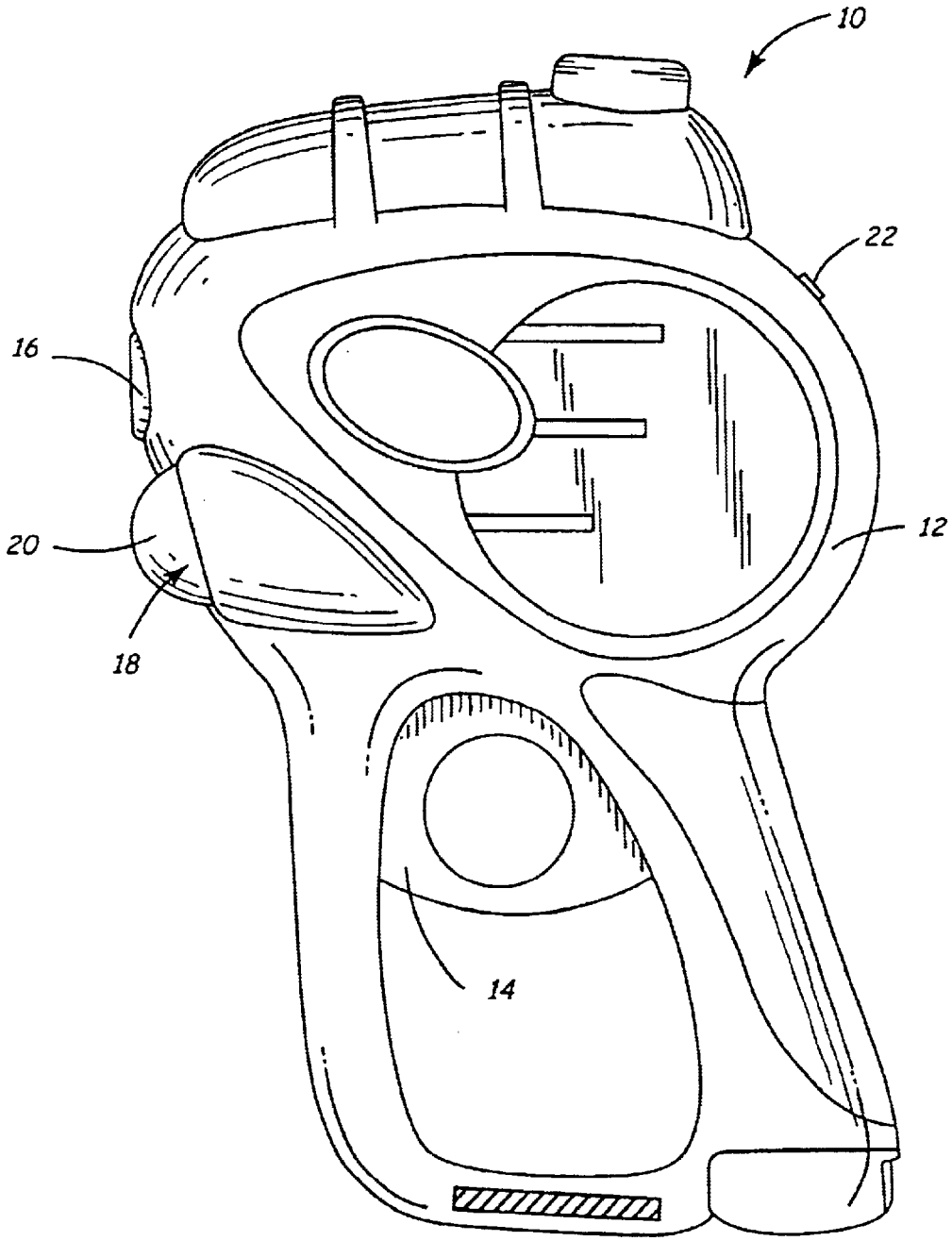
FIG. 1 is side elevational view of a hand held bubble making device consistent with the principals of the present invention.

FIG. 1 is a side elevational view of a bubble producing amusement device 10. Device 10 includes a suitable housing 12 formed form plastic or various other appropriate materials. Device 10 includes a trigger 14 and a front nozzle 16. Front nozzle 16 is positioned above a lens 20, which covers light source 18. Housing 12 may also include an optional two way switch 22 to allow for the selection of various lighting parameters, such as continuous emission, flashing, or the like. In use, an operator grips device 10 and may optionally select the appropriate lighting configuration. The operator then engages trigger 14 causing bubbles to be emitted from front nozzle 16. At the same time, light source 18 is turned on and illuminates the bubbles departing from and proximate to front nozzle 16.

Figure 2:
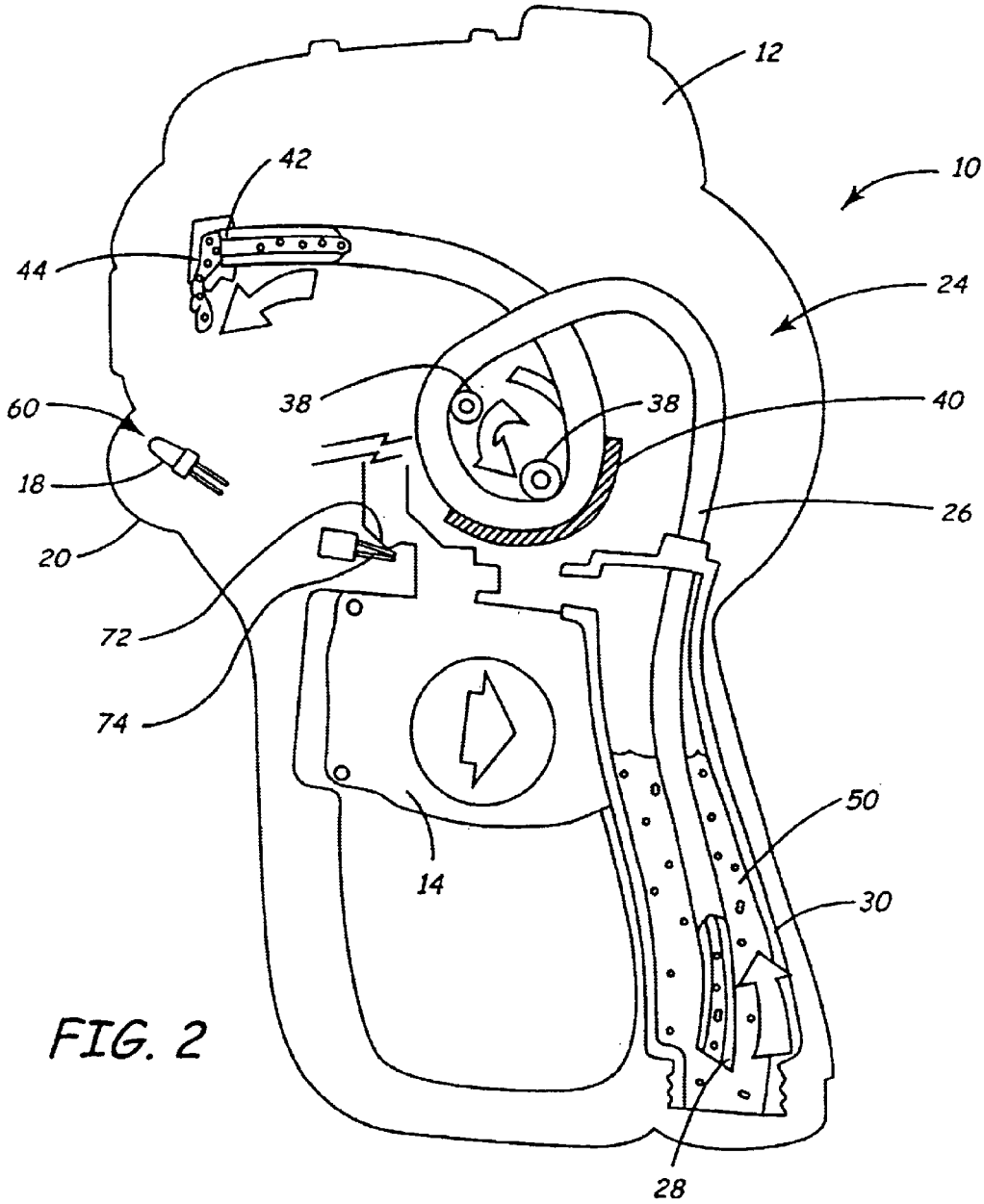
FIG. 2 is partially sectional, side elevational view of the hand held bubble making device of FIG. 1.
Figure 3:
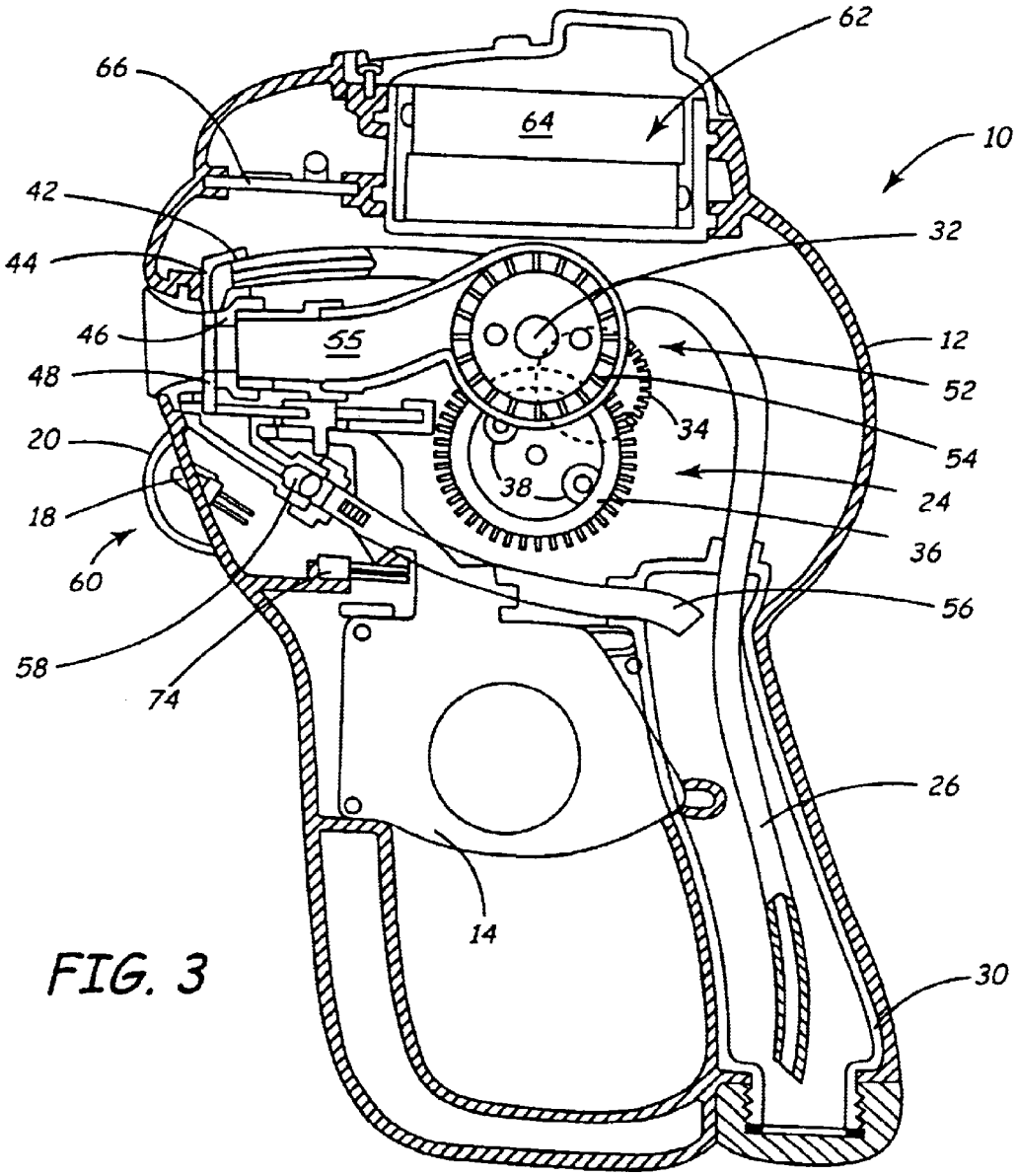
FIG. 3 is a partially sectional, side elevational view of the hand held bubble making device of FIG. 1.

To facilitate the above operation, housing 12 includes various assemblies. FIGS. 2 and 3 illustrate a capillary pump assembly 24. A feed hose 26 has a first free end 28 disposed within a tank 30. Tank 30 is a refillable vessel containing an appropriate volume of bubble making solution. Capillary pump assembly 24 includes a motor 32 (FIG. 4) that is coupled with a transfer gear 34 and a pump gear 36. As illustrated, pump gear 36 includes a pair of pump rollers 38. Capillary pump assembly 24 is configured so that a portion of feed hose 26 is disposed between pump rollers 38 and an arcuate portion 40 of housing 12. Thus, motor 32 causes pump gear 36 to rotate, which in turn causes pump rollers 38 to rotate in a counterclockwise direction (as illustrated) and to cyclically compress feed hose 26. As feed hose 26 is compressed, fluid within feed hose 26 moves through feed hose 26 and out through nozzle 42. The compression of feed hose 26 and the resultant movement of fluid generate a vacuum in the lower portion of feed hose 26. The generated vacuum serves to draw fluid from tank 30 into feed hose 26. In this manner, pump assembly 24 cyclically draws fluid into feed hose 26 and expels the fluid from nozzle 42.

Figure 4:
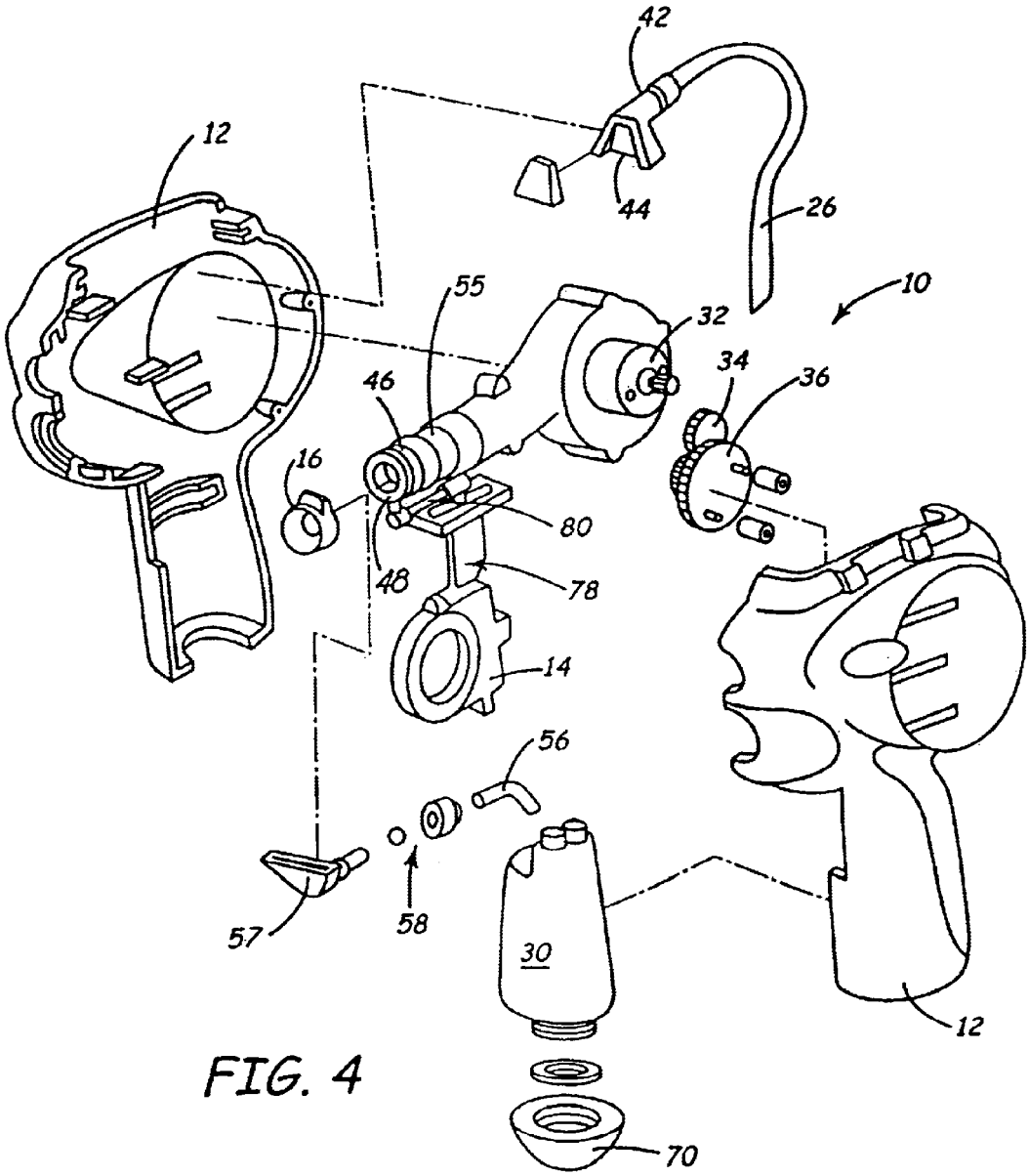
FIG. 4 is an exploded view of certain subassemblies of the hand held bubble making device of FIG. 1.
Figure 5A:
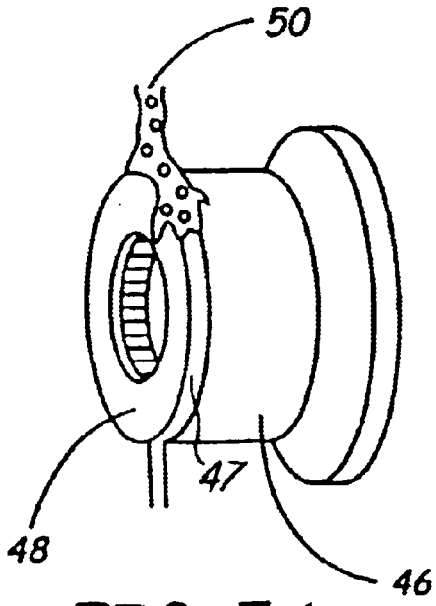
FIGS. 5A and 5B are perspective views illustrating a dispensing nozzle and dispensing ring, consistent with the principles of the present invention.
Figure 5B:
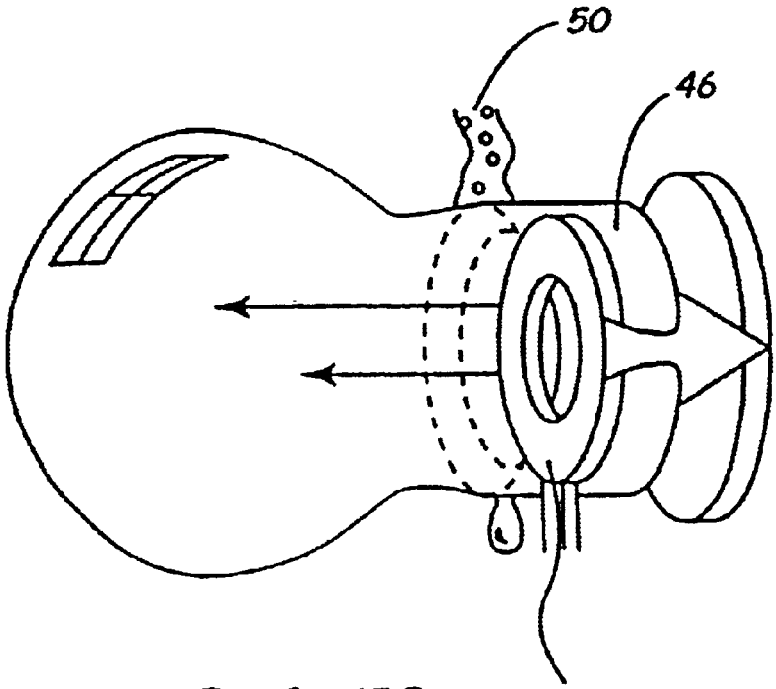

As fluid is expelled from nozzle 42, a fanning tip 44 distributes the fluid and serves to produce fluid flow over a specific width. Referring to FIGS. 4, 5A, and 5B, that width generally corresponds with a dispensing nozzle 46 and a dispensing ring 48. Dispensing ring 48 is a moveable annular ring that moves into and out of axial alignment with the generally circular dispensing ring 48. As most clearly illustrated in FIGS. 5A and 5B, bubble making solution flows from fanning tip 44 onto and between dispensing nozzle 46 and dispensing ring, 48. In FIG. 5A, dispensing nozzle 46 and dispensing ring 48 are axially aligned as the bubble making solution flows. The circular configuration of dispensing nozzle 46 and dispensing ring 48 serve to facilitate fluid flow about a majority of the perimeter of dispensing nozzle 46. That is, as fluid drips down, the fluid flows between dispensing nozzle 46 and dispensing ring 48 (either because they are spaced apart or appropriate ridges or grooves are provided) and flows about the facing generally circular portions.

As the operator engages trigger 14, dispensing ring 48 moves out of axial alignment, as illustrated in FIG. 5B. As this occurs, dispensing ring 48 distributes the bubble making solution across dispensing nozzle 46 so as to create a thin film of bubble making solution 50 over the opening of dispensing nozzle 46.

Once the thin film is created and dispensing ring 48 is again axially aligned with dispensing nozzle 46, air flow out of dispensing nozzle 46 causes bubbles to be formed and expelled through front nozzle 16. Again referring to FIGS.

3 and 4, the same motor 32 used to drive capillary pump assembly 24 drives a fan assembly 52. Fan assembly 52 includes a circular set of fan blades 54 that generate air flow through sleeve 55 and out through dispensing nozzle 46 when rotated.

Recycling funnel 57, located below dispensing nozzle 46 and dispensing ring 48, collects any excess bubble making solution that is dispensed. Recycling funnel 57 directs the excess fluid through recycling hose 56, which empties into tank 30. Gravity directs the fluid from the recycling funnel 57 to tank 30. Should device 10 become inverted, a one way valve 58 prevents fluid flow toward the recycling funnel 57.

Referring to FIG. 3, a light assembly 60 is illustrated. Light assembly 60 includes a light source 18, such as one or more LEDs, bulbs or other light emitting devices. A protective lens 20 covers light source 18, and may optionally be configured to alter light emitted from light source 18 such as by focusing or filtering the light. Light assembly 60 is positioned proximate front nozzle 16 so that bubbles ejected from device 10 are illuminated. Other light assemblies could be provided for further illumination of the bubbles or to simply add visual appeal to other portions of device 10.

A power source 62 provides power for all of the electrical components of device 10, such as motor 32 and light assembly 60. Power source 62 can be one or more batteries 64 or any other suitable source of power. An optional circuit board 66 controls light assembly 60 so as to determine whether light assembly 60 is continuously illuminated or flashed during use. Furthermore, when multiple light sources 18 are utilized, circuit board 66 controls which light sources 18 are illuminated and their lighting sequence. The operator controls the lighting parameters by adjusting switch 22, which toggles circuit board 66 in the appropriate manner.

In use, an operator removes tank cover 70 and fills tank 30 with bubble making solution 50 and then replaces tank cover 70. If not already provided, batteries 64 (or an alternate source of power) are inserted. The operator then grips device 10 in a gun-like manner and engages trigger 14. Each time trigger 14 is pulled, motor 32 engages for a predetermined period of time. In addition, each time trigger 14 is pulled, a contact tip 72 that is attached to trigger 14 causes contact switch 74 to close. Contact switch 74 triggers the actuation of motor 32 and light source 18. Motor 32 causes pump gear 36 to rotate, which in turn causes pump rollers 38 to cyclically compress feed hose 26. The cyclical compression generates a vacuum that draws fluid from tank 30 into feed hose 26. The compressions caused by pump rollers 38 force the drawn fluid out through fanning tip 44.

The bubble making solution 50 expelled from fanning tip 44 drips over dispensing nozzle 46 and dispensing ring 48. Each time trigger 14 is pulled, trigger assembly 78 moves and pulls push arm 80. Push arm 80 is coupled to dispensing ring 48; thus, each time trigger 14 is pulled, dispensing ring 48 moves across dispensing nozzle 46 and aides in the generation of a thin film of bubble making solution 50. In one embodiment, dispensing ring 48 is spaced apart from dispensing nozzle 46 to allow fluid flow therebetween. Alternatively, dispensing ring 48 could contact dispensing nozzle 46, either continuously or during a portion of the travel path. When dispensing nozzle 46 and dispensing ring 48 are configured to contact one another, slots or grooves may be provided in one or both components to facilitate fluid flow.

As motor 32 has already been engaged, fan assembly 52 generates air flow out of dispensing nozzle 46. The air flow passes through dispensing nozzle 46 and axially aligned dispensing ring 48 to form bubbles which are then ejected through front nozzle 16. Recycling funnel collects excess bubble making solution and returns the solution to tank 30.

When trigger 14 is engaged, light source 18 illuminates, either continuously or in a flashing sequence, for a predetermined period of time. Thus, as bubbles are ejected from device 10 they are illuminated, providing a pleasing visual experience.

The operator may repeatedly pull trigger 14 to continue the bubble making process. After a predetermined period of time has passed from the last pulling of trigger 14, motor 32 and light source 18 are caused to turn off. Device 10 can then be stored for future use. That is, tank 30 provides a fluid tight seal whereby bubble making solution is retained therein. Furthermore, one-way valve 58 prevents fluid flow out of tank 30 and through recycling funnel 57, should device 10 become inverted.

Although the present invention has been described with reference to selected embodiments, persons skilled in the art will recognize that changes may be made in form and detail without departing from the spirit and scope of the invention.

I claim:

1. A bubble making apparatus comprising:

a housing having an internal chamber, a dispensing opening connecting with the internal chamber and substantially open to outside air, a sleeve mounted within the dispensing opening and having a dispensing surface;

a tank mounted on the housing to contain a liquid capable of producing bubbles;

a pump mounted on the housing and connected to the tank by a tube so as to supply liquid to the pump;

a source of blown air originating from within the internal chamber, the blown air to be dispensed through the sleeve and out of the apparatus; and a film producing mechanism operably carried by the housing and including a dispensing ring located adjacent to the dispensing surface and movable parallel to the dispensing surface, wherein liquid from the tank is moved by the pump to the dispensing surface and the dispensing ring distribute a thin film of the liquid across the dispensing surface, wherein the pump arrangement comprises a pump gear that carries a pump roller for contacting the feed hose to create a capillary action to move bubble solution from the tank to the dispensing opening.

2. The bubble making apparatus of claim 1, further comprising an arcuate portion of the housing positioned to allow the pump roller to pinch the feed tube to create the vacuum to transport the solution through the feed hose to the dispensing opening.

3. The bubble making apparatus of claim 1, further comprising a light source positioned on the housing adjacent to the dispensing surface, wherein the light source illuminates bubbles ejected from the bubble making apparatus.

4. The bubble making apparatus of claim 3, wherein the light source is an LED.

5. The bubble making apparatus of claim 3, wherein the light source flashes.

6. The bubble making apparatus of claim 1, further comprising:

a recycling funnel located proximate to the dispensing surface;

a recycling tube interconnecting the recycling funnel and the tank; and a one-way valve disposed within the recycling tube to prevent fluid flow in a direction from the tank to the recycling funnel.

7. The bubble making apparatus of claim 1, further comprising a fanning tip coupled with the dispensing opening to provide fluid across the dispensing surface.

8. A bubble making device comprising:

a sleeve having a dispensing surface;

a dispensing ring positioned adjacent to said dispensing surface of said sleeve, wherein said dispensing ring is moveable into and out of axial alignment with said dispensing surface of said sleeve;

a reservoir for containing a bubble forming solution;

a feed hose which operately links said reservoir to said sleeve; and a pump arrangement comprising a transfer gear coupled to a pump gear which carries pump rollers for contacting said feed hose to create a capillary action to move said bubble forming solution from said reservoir to said dispensing surface.

9. The bubble making device of claim 8, further comprising a housing, wherein said sleeve, said dispensing ring, said feed hose, said reservoir, and said pump arrangement are all each disposed within said housing.

10. The bubble making device of claim 9, further comprising an arcuate portion of the housing positioned to allow the pump roller to pinch the feed tube to create the vacuum to transport the solution through the feed hose to the dispensing opening.

11. The bubble making device of claim 8, further comprising a light source positioned adjacent to the dispensing nozzle, wherein the light source illuminates bubbles ejected from the bubble making apparatus.

12. The bubble making device of claim 11, wherein the light source is an LED.

13. The bubble making apparatus of claim 11, wherein the light source flashes.

14. The bubble making device of claim 8, further comprising:

a recycling funnel located proximate to the dispensing surface;

a recycling tube interconnecting the recycling funnel and the reservoir; and a one-way valve disposed within the recycling tube to prevent fluid flow in a direction from the reservoir to the recycling funnel.

15. The bubble making apparatus of claim 8, further comprising a fanning tip coupled with said sleeve to provide fluid across the dispensing surface.

16. The bubble making device of claim 8, further comprising a motor operatively coupled to said pump arrangement to cause said pump gear of said pump arrangement to rotate, which in turn causes said pump rollers to rotate and to compress feed hose.

17. The bubble making device of claim 16, further comprising a fan assembly coupled with said motor and positioned to direct air flow through said sleeve.

18. The bubble making device of claim 17, further comprising a trigger assembly, wherein actuation of the trigger assembly engages said motor and causes the dispensing ring to move out of and into axial alignment with said dispensing surface, wherein movement of the dispensing ring causes a thin film of bubble making solution to form across said dispensing surface.

* * * * *